US007331470B2

(12) United States Patent
Vernon et al.

(10) Patent No.: US 7,331,470 B2
(45) Date of Patent: Feb. 19, 2008

(54) MAGNETIC RAKE WITH RELEASE MECHANISM

(76) Inventors: Bradley G. Vernon, 625 Funston St., San Luis Obispo, CA (US) 93401; Patrick D. Arnold, 4915 Jespersen Rd., San Luis Obispo, CA (US) 93401

( * ) Notice: Subject to any disclaimer, the term of this patent is extended or adjusted under 35 U.S.C. 154(b) by 0 days.

(21) Appl. No.: 11/338,607

(22) Filed: Jan. 24, 2006

(65) Prior Publication Data

US 2006/0186025 A1 Aug. 24, 2006

Related U.S. Application Data

(63) Continuation-in-part of application No. 10/699,485, filed on Oct. 30, 2003.

(60) Provisional application No. 60/646,668, filed on Jan. 24, 2005, provisional application No. 60/423,774, filed on Nov. 4, 2002.

(51) Int. Cl.
*B07B 1/49* (2006.01)
*B66C 1/04* (2006.01)

(52) U.S. Cl. ..... 209/417; 209/215; 209/213; 209/418; 209/419; 294/65.5

(58) Field of Classification Search ..... 209/417, 209/418, 419; 56/400.01, 400.04, 400.19
See application file for complete search history.

(56) References Cited

U.S. PATENT DOCUMENTS 2,056,906 A * 10/1936 Parkhill ..... 209/217
3,108,426 A * 10/1963 Rugg ..... 56/400.01
4,017,386 A * 4/1977 Barry ..... 209/215
4,291,430 A * 9/1981 Hightower ..... 15/142
4,741,150 A * 5/1988 Saksun ..... 56/400.21
4,828,690 A * 5/1989 Montez ..... 209/418
5,179,825 A * 1/1993 Griffiths et al. ..... 56/400.05
5,395,148 A * 3/1995 Jameson et al. ..... 294/65.5
5,408,818 A * 4/1995 Damron ..... 56/400.04
5,429,402 A * 7/1995 Kennedy ..... 294/65.5
5,927,057 A * 7/1999 Hueber ..... 56/400.06
5,979,957 A * 11/1999 Conrad et al. ..... 294/65.5
6,009,697 A * 1/2000 Billado ..... 56/400.08
6,113,169 A * 9/2000 Gohman et al. ..... 294/65.5
6,142,310 A * 11/2000 Haase et al. ..... 209/215
D458,095 S * 6/2002 Hueber ..... D8/13

* cited by examiner

*Primary Examiner*—Gene O. Crawford
*Assistant Examiner*—Terrell Matthews
(74) *Attorney, Agent, or Firm*—Knobbe, Martens, Olson & Bear, LLP

(57) ABSTRACT

A magnetic raking device that agitates a ground surface and uses magnetic attraction for collecting ferro-metallic debris, such as nails and screws, at construction jobsites and other locations, includes a release mechanism that temporarily eliminates magnetic attraction of the debris to the rake, thus allowing collected debris to drop from the rake, such as into a trash or recycling container. One type of release mechanism physically removes one or more magnets from the rake body to eliminate magnetic attraction to the rake body. One type of release mechanism uses electromagnets in the rake body that attract ferro-metallic debris when current is allowed to run through the electromagnets, and that allows the debris to drop from the rake when the current is interrupted. The magnetic rake may be used in an inverted position to attract ferro-metallic debris without agitating, and may be used in a non-magnetic state as a conventional rake.

14 Claims, 6 Drawing Sheets

MAGNETIC RAKE WITH RELEASE MECHANISM

CROSS REFERENCE TO RELATED APPLICATIONS

The current application is a continuation-in-part of U.S. application Ser. No. 10/699,485, filed Oct. 30, 2003, titled MAGNETIC RAKE, which claims the benefit of priority under 35 U.S.C. § 119(e) of U.S. Provisional Application No. 60/423,774, filed on Nov. 4, 2002, and the current application also claims the benefit of priority under 35 U.S.C. § 119(e) of U.S. Provisional Application No. 60/646,668, filed on Jan. 24, 2005, all of the aforementioned applications being hereby incorporated herein by reference in their entireties and made part of the present disclosure.

FIELD OF THE INVENTION

This invention relates to devices used to retrieve nails and other unwanted metal object from yards, lawns, garages, and other areas.

BACKGROUND OF THE INVENTION

Clean-up of small ferro-metallic items at a construction site, playground, or similar location can be very difficult to carry out in a cost- and time-effective manner. In the construction industry, providing a clean and safe environment, both during the building phase and upon completion, is very important. Screws and nails, which are often discarded throughout the day by employees, can be very dangerous. This danger poses a problem to vehicles as well as to people on the jobsite. These items, if not immediately picked up, may become lodged in the ground over time, especially if the soil has become dampened, as from rain, causing the soil to compact and harden. Ferro-metallic items also remain buried in ground coverings, such as gravel and taller grass, and magnetic force alone will often not disentangle and remove these items.

One current type of tool that is used for this purpose is a hand-held magnetic wand or other implement that can be waved or lightly dragged over the ground to attract ferro-metallic items off the surface. These types of devices cannot agitate the soil or other ground cover to consistently and sufficiently pick up the dangerous ferro-metallic items that may be embedded in the ground cover.

Another type of current device used to pick up ferro-metallic items is a large rolling magnetic sweeper, which cannot maneuver well around shrubbery. Such rolling sweepers may be a viable option when sweeping larger, hard, smooth surfaces of ferro-metallic items, but they are unable to get in around shrubbery and other tight areas to retrieve the ferro-metallic items. Furthermore, rolling sweeper devices sweep over the ground surface without digging into the ground surface, thus potentially missing debris that is wholly or partially buried in the ground. Adding lightweight tines to the sweeper, such as the flexible tines of the types commonly used for a leaf rake, does not provide the device with strength to unearth nails or other debris that has become embedded in compacted soil or buried amongst taller grass or gravel.

As ferro-metallic items become buried in the ground, it is sometimes customary to first mechanically agitate the ground with a conventional rake, and then to follow up with a magnetic pick-up device, making the job a two-step process, and requiring two different tools, in order to do an effective job.

Furthermore, the surface of a magnetic pick-up device may become loaded during use with the ferro-metallic debris that has been attracted to it, making the device very heavy to maneuver and reducing its effectiveness. Lifting the heavily loaded device and knocking off the debris or taking steps to reduce a magnetic field associated with the device may rid the device of the heaviest of the debris, but may not successfully release all of the debris, especially lighter-weight debris, such as staples and metallic filings, that remain more readily attracted to a magnetic field of lesser strength.

Magnetic devices that do not provide a shut-off or magnet-release mechanism, or that do not allow a user to comfortably keep the rake in a non-magnetized state, suffer from the limitation that the rake is always used as a magnetic rake, without an option for use as a conventional, non-magnetized rake.

SUMMARY OF THE INVENTION

A magnetic rake is described that combines, as a one-step process, the functions of raking the ground and picking up ferro-metallic items, such as screws, nails, and staples, at a construction jobsite, playground, park, or other area, and that further provides an easy and highly effective release mechanism that eliminates a magnetic field associated with the rake and thus allows the ferro-metallic items to drop away from the now non-magnetic rake. The rake comprises a hollow, unitarily-formed, toothed rake body that encloses one or more magnets, which attract ferro-metallic items to the rake body during raking. A toothed portion of the rake body allows for use of the magnetic rake in a conventional position in which the rake is pushed and/or pulled, teeth facing downwards, across a ground surface, allowing the teeth to agitate the ground surface medium. Some embodiments of the release mechanism may eliminate the magnetic field that attracts ferro-metallic debris to the rake by physically withdrawing one or more permanent magnets from the rake. Some embodiments of the release mechanism may eliminate the magnetic field that attracts ferro-metallic debris to the rake by cancelling the magnetic field of one or more electromagnets enclosed within the rake body.

The release mechanism may be a device that is integrated into or attached to the magnetic rake that eliminates magnetic attraction to the rake such that the metal debris may fall off the rake into a trash can or other suitable container, which is advantageous for several reasons. For example, it is safer for a user to not touch the metal debris with the hand. As another example, the release mechanism makes it easier for the user to accurately deposit the debris in a desired location, for example, to deposit the ferro-metallic debris into a trash or recycling container or to simplify recovery of useful items like nails, screws, and the like, for reuse. As a further example, by eliminating a magnetic field associated with magnets inside the magnetic rake, the rake become non-magnetic and may be used, while desired, as a conventional, non-magnetic rake. Embodiments of the release mechanism described herein further allow the rake to be returned to its magnetic state, when desired, and to be used again to collect ferro-metallic debris. Thus, the magnetic rake with release mechanism may serve as a magnetic and as a non-magnetic tool.

The magnetic rake described herein simplifies and speeds up the process of maintaining a clean and safe jobsite work environment or play area. Embodiments of the magnetic rake fill a void in the marketplace for a mid-sized magnetic pick-up tool.

Embodiments of a magnetic rake are described. The magnetic rake comprises a hollow, unitarily-formed, toothed rake body configured to enclose a first set of one or more magnets that attract ferro-metallic material to the rake body and a release mechanism that eliminates attraction of the ferro-metallic material to the rake body.

Embodiments of a method of removing ferro-metallic material from a surface area are described, comprising the acts of: magnetically attracting ferro-metallic material from a surface area to a hollow, unitarily-formed toothed rake body that contains at least one magnet inside and that comprises a release mechanism that eliminates the magnetic attraction; and activating the release mechanism to allow the ferro-metallic material to drop from the rake body.

Embodiments of a system for removing ferro-metallic debris from a surface area are described. The system comprises: means for agitating the surface area; means, enclosed within the means for agitating, for magnetically attracting ferro-metallic material from the surface area to the means for agitating; and means for eliminating the magnetic attraction to the rake body.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

A general architecture that implements various features of specific embodiments of the invention will now be described with reference to the drawings. The drawings and the associated descriptions are provided to illustrate embodiments of the invention and not to limit the scope of the invention. Throughout the drawings, reference numbers are re-used to indicate correspondence between referenced elements.

DETAILED DESCRIPTION OF THE PREFERRED EMBODIMENT

Embodiments of a hand-operated magnetic raking device with a release mechanism are described, comprising a handle attached to a toothed rake body that houses one or more magnets, and a release mechanism for the one or more magnets. The device may be used to agitate various types of ground cover medium, such as grass, gravel, dirt, and the like, much in the manner of a conventional rake, and to simultaneously pick up ferro-metallic particles that are attracted by magnetic force to the rake body. Thus, the magnetic rake provides two functions at the same time: raking and magnetic pick-up. Embodiments of the release mechanism eliminate the magnetic attraction of the ferro-metallic debris to the rake body and include embodiments that physically remove at least one magnet from the rake body. In other embodiments of the magnetic rake, the one or more magnets are electromagnets, and the release mechanism allows electrical current to the electromagnets to be turned on and off, using electricity, thereby activating and de-activating a magnetic field associated with the electromagnets.

Figure 1:
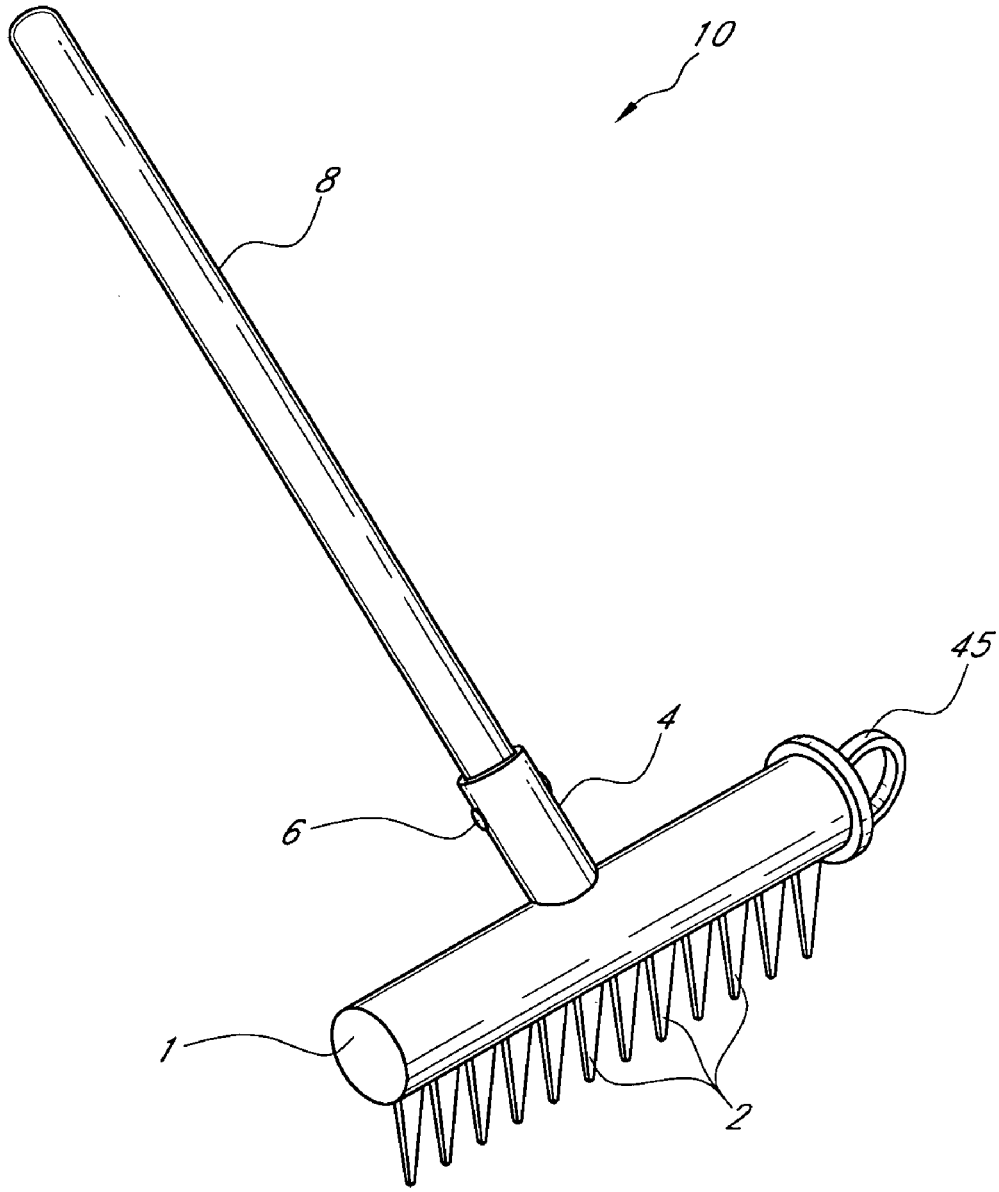
FIG. 1 depicts one embodiment of a magnetic rake with a release mechanism.

FIG. 1 depicts one embodiment of a magnetic rake 10 with a release mechanism. As depicted in FIG. 1, the magnetic rake 10 comprises a rake body 1 with a toothed portion 2 and a hollow portion that contains one or more magnets, as will be described in greater detail with reference to FIG. 3. In FIG. 1, the hollow portion of the rake body 1 is depicted as being of a cylindrical shape. However, in other embodiments, the rake body 1 may be formed in other advantageous shapes for containing one or more magnets.

A handle sleeve 4 is attached to the rake body 1 using any of a variety of methods, such as by welding, that provides an attachment sufficiently strong and long-lasting to endure use under rugged, construction site conditions. A rake handle 8 may be inserted into the handle sleeve 4 and attached using a mechanical system, such as a bolt 6, effectively attaching the handle 8 to the toothed rake body 1, as will be described in greater detail with reference to FIG. 3.

In FIG. 1, the magnetic rake 10 comprises an embodiment of a release mechanism that involves physically removing the one or more magnets from the rake body 1 using a pull ring 45, as will be described in greater detail with reference to FIGS. 4A and 4B to follow.

Figure 2:
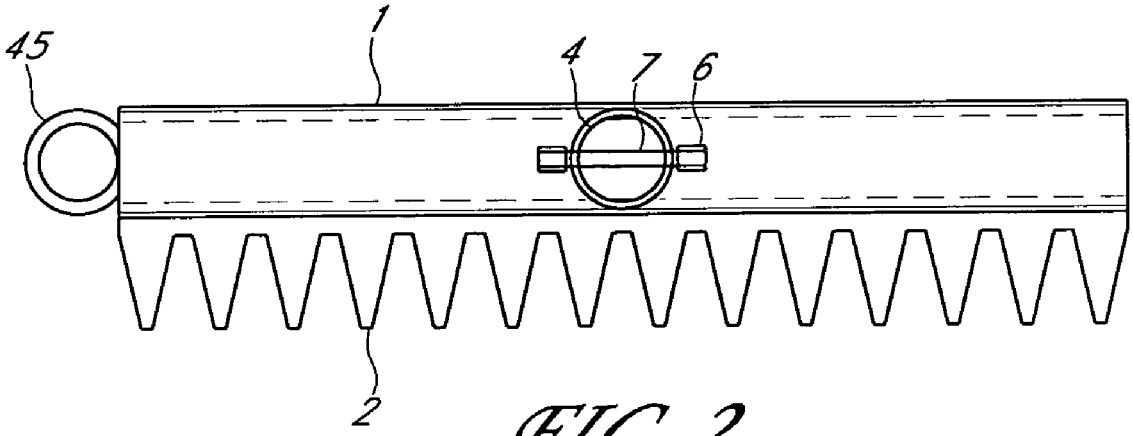
FIG. 2 depicts a plan view of one embodiment of a rake body extrusion for a magnetic rake.
Figure 3:
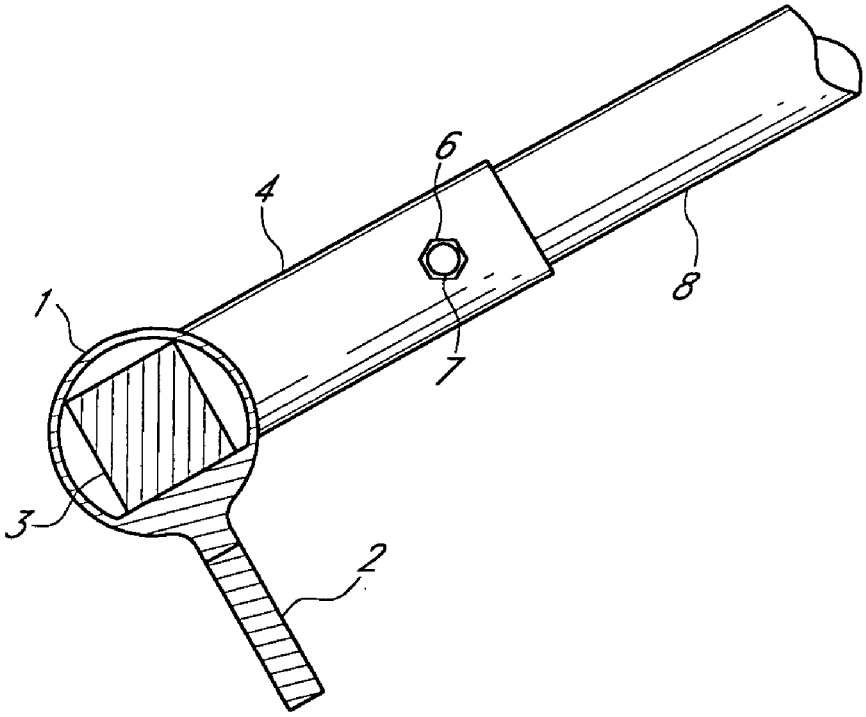
FIG. 3 depicts a cut-away side view of one embodiment of the rake body enclosing a magnet and connected to an inserted handle.

FIG. 2 depicts a plan view of one embodiment of the rake body 1 for the magnetic rake 10. FIG. 3 depicts a cut-away side view of one embodiment of the rake body 1 enclosing a magnet 3 and connected to an inserted handle 8. In the embodiment depicted in FIGS. 2 and 3, the rake body 1 may, in some embodiments, be extruded into a substantially cylindrical or other convenient shape comprising a space for holding and containing one or more magnets 3. From a non-magnetic alloy, such as aluminum, the rake body 1 may be extruded into a convenient length for a desired application. For instance, a length of fourteen inches is frequently desirable for clean-up around existing shrubbery. A length of thirty inches may be desirable for larger clean-up jobs. As will be familiar to one of skill in the art upon reading this disclosure, in making various embodiments of the magnetic rake, different lengths of rake bodies 1 may be desirable, based at least in part on expected sizes and scopes of clean-up jobs for which the magnetic rake will likely be used.

As further depicted in FIGS. 2 and 3, a toothed portion 2 extending away from the rake body 1 may be formed in the rake body extrusion 1 by machining, stamping, cutting, or another method, as will be familiar to one of ordinary skill in the art. In various embodiments, the teeth 2 may be shaped in a fashion that provides them with rigid strength and allows them to effectively agitate surfaces such as grass, gravel, sand and hard-packed dirt when pushed and/or pulled by a user. As shown in the embodiments depicted herein, the teeth 2 may be substantially triangular in shape. The number of teeth 2 and shape of the teeth 2 may vary in different embodiments.

The handle 8 is mounted to the handle sleeve 4 to provide for easy push/pull use of the magnetic rake 10, in much the same manner as would be associated with use of a conventional rake. In the embodiment shown in FIGS. 2 and 3, the handle 8 is attached to the handle sleeve 4 using a mechanical system 6, such as a bolt that is positioned to run through a matching set of holes 7 in both the handle sleeve 4 and the handle 8. In other embodiments, other methods of attaching the handle 8 to the handle sleeve 4 may be used. The length of the handle 8 may be the same as that of a conventional rake, but, in various embodiments, may also vary at least in part according to size and scope of the areas to be raked and cleaned of ferro-metallic particles, according to the length of the rake body 1, according to an expected load of ferro-metallic debris to be attracted to the rake body 1, and/or according to one or more other criteria.

FIG. 3 depicts an embodiment of the magnetic rake with a removable handle 8. The removable handle 8 provides the advantages of allowing for a subsequent replacement of the handle 8, if necessary, as well as allowing for more convenient packaging and possibly even a more economical shipping cost. Although an inserted and replaceable handle 8 is shown in FIG. 3, a non-removable handle 8, such as a handle 8 that is welded on to the handle sleeve 4 or directly to the rake body 1, or molded in one piece with the rake body 1, may be used, if desired.

As shown in FIG. 3, one or more magnets 3 may be placed inside of a hollow portion of the rake body 1, the magnet 3 providing magnetic attraction to the ferro-metallic items to be picked up. A square magnet 3 is shown in FIG. 3, but any of a variety of shapes of magnets may be used, as desired. In some embodiments of the magnetic rake 10, the rake body 1 encloses multiple magnets 3. In various embodiments, the one or more magnets are permanent magnets. However, as will be described with reference to FIGS. 5A and 5B and elsewhere in this disclosure, in some embodiments, the magnets may be electromagnets.

The magnetic rake 10 may also be used in an inverted position, with the teeth 2 of the rake body 1 facing upwards, away from the ground surface, and an un-toothed, smooth backside of the rake body 1 placed adjacent to the ground. Use of the magnetic rake 10 in the inverted position to pick up ferro-metallic particles without using the teeth 2 may be especially useful along smooth and/or hard surfaces, such as concrete, hard-packed soil, garage floors, and the like.

Various embodiments of release mechanisms for use with the magnetic rake 10 will now be described with reference to FIGS. 4A, 4B, 5A, and 5B. The release mechanisms described herein eliminate magnetic attraction to the rake 10, and, in effect, render the rake 10 to be non-magnetic while the release mechanism is in effect, as will be described in greater detail with reference to the embodiments.

When the rake 10 is in a non-magnetic state, any ferro-metallic debris collected on the rake body 1 ceases to be attracted to the rake body 1 and is free to drop from the rake body 1. Thus, a user may conveniently and safely dispose of debris that was collected by the rake 10 while in a magnetic state, and may easily return the rake 10 to a magnetic state to again collect another load of ferro-metallic debris on the rake body 1.

By eliminating magnetic attraction to the rake 10, the release mechanism allows the debris to be fully detached from the rake body 1, including small and light-weight particles of the debris that may remain attracted to a merely diminished amount of magnetic force. Furthermore, if desired, the rake 10 may be used as a conventional, non-magnetic rake while the release mechanism continues to eliminate magnetic attraction to the rake body 1.

Figure 4A:
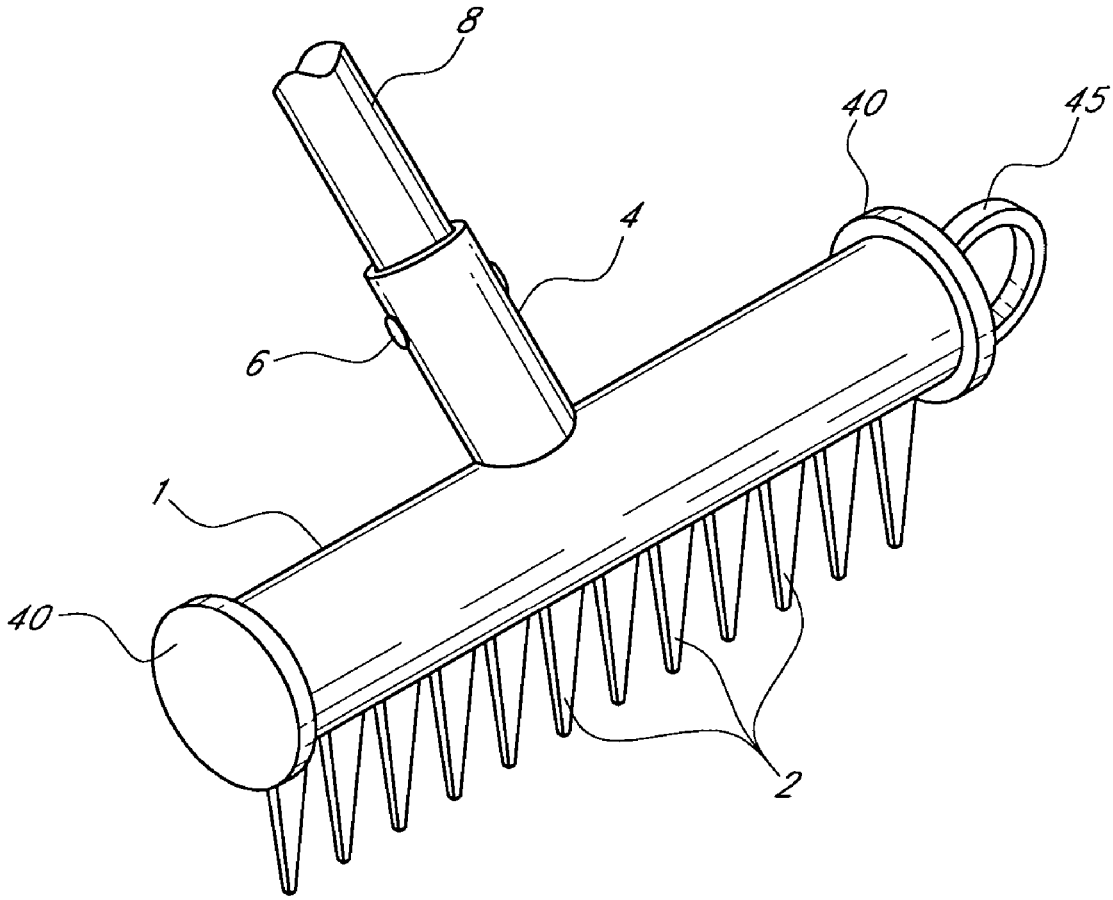
FIG. 4A depicts an embodiment of a magnetic rake with a release mechanism that uses a manually removable magnet and stripper plates.
Figure 4B:
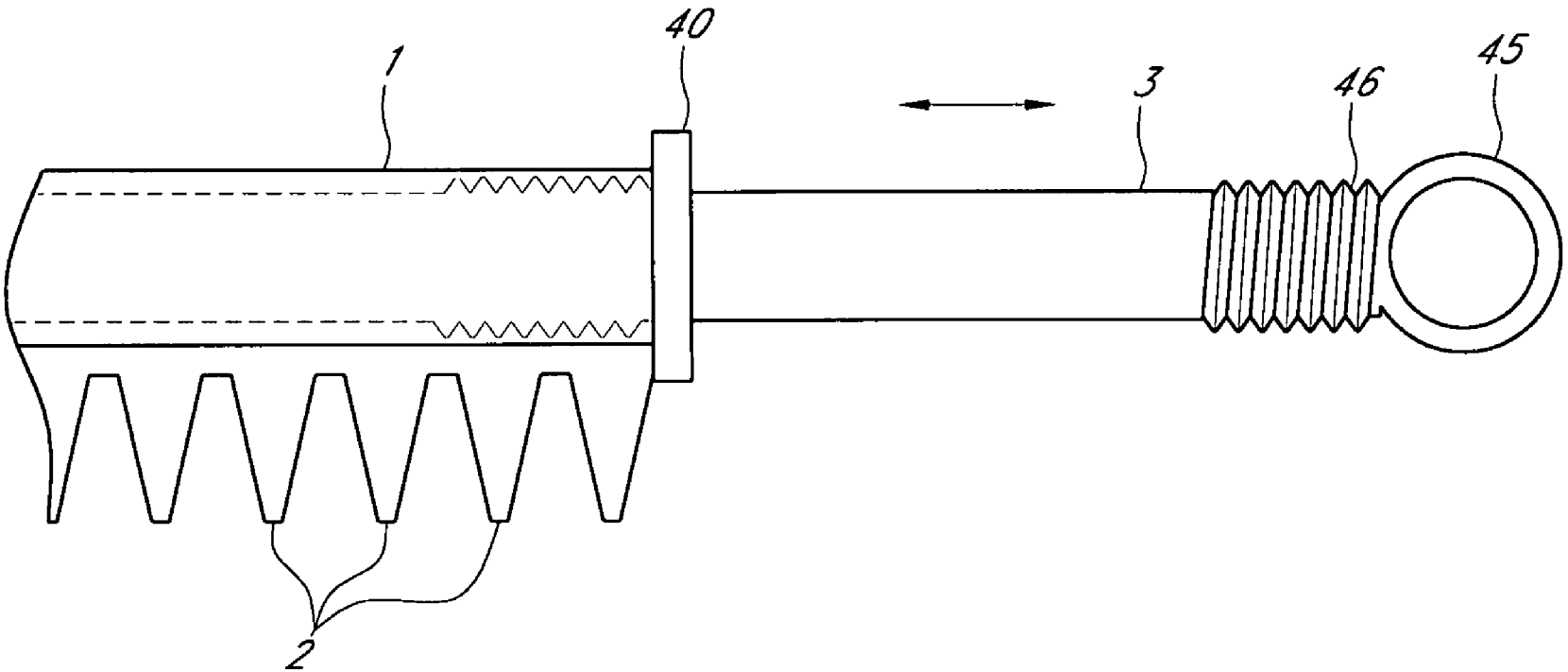
FIG. 4B depicts a more detailed view of an embodiment of a magnetic rake with a manually removable magnet, in which the removable magnet is partially withdrawn from the rake body.

FIGS. 4A and 4B depict an embodiment of a magnetic rake 10 with a release mechanism that uses a manually removable magnet with a pull ring 45 and one or more stripper plates 40 to eliminate the magnetic attraction of ferro-metallic debris to the rake body 1. As will be described in greater detail with reference to FIG. 4B to follow, pulling the pull ring 45 withdraws a magnet 3 from within the rake body 1, thereby eliminating any magnetic attraction to the rake body 1 and allowing any collected ferro-metallic debris to drop from the rake body 1.

In some embodiments, one or more stripper plates 40 or other type of barrier may be situated on the rake body 1, such as at one or both ends of the rake body 1, in order to catch any debris that may be attracted to the magnet 3 as it is being withdrawn from the rake body 1. Thus, the debris does not attach to the magnet 3, but is instead stopped by the stripper 40 and drops from the rake body 1 once the magnet 3 is removed.

In some embodiments, only one stripper plate 40 is used. The stripper plate 40 is preferably situated substantially at an end of the rake body 1 that adjacent to the pull ring 45, so that when the magnet rod 3 is withdrawn from the rake body 1 with the pull ring 45, the single stripper plate obstructs debris from becoming attached to the magnet 3. In other embodiments, two or more stripper plates 40 are attached substantially near to two ends of the rake body 40. When two stripper plates 40 are attached the rake body 1, and when the rake 10 is used in an inverted position, the rake body 1 rests on two stripper plates 40, thereby maintaining an even distance between the ground surface and the rake body 1 along the length of the rake body 1.

FIG. 4B depicts a more detailed view of an embodiment of a magnetic rake 10 with a manually removable magnet 3, in which the removable magnet 3 is partially withdrawn from the rake body 1. In the embodiment depicted in FIG. 4B, a hollow interior portion of the rake body 1 is substantially cylindrical in shape and the magnet 3 is formed as a substantially cylindrical rod with the pull ring 45 attached to one end of the magnet 3. As the pull ring 45 is pulled away from the rake body 1, the magnet rod 3 is withdrawn from the hollow interior of the rake body 1. The stripper plate 40 stops any ferro-metallic debris from attaching to the magnet 3 as it is being withdrawn.

The substantially cylindrical magnet 3 depicted in FIG. 4B may be rotated inside of the rake body 1. As further depicted in FIG. 4B, the magnet rod 3 may be formed to include one or more threaded portions 46 that allow the magnet rod 3 to be screwed into a corresponding one or more threaded portions on an interior wall of the rake body 1 when the magnet 3 is inserted into the rake body 1 for use of the magnetic rake 10 in a magnetic state. By screwing the magnet 3 into the rake body 1, the magnet 3 may be held firmly in place inside the rake body 1 during use.

In other embodiments, such as in embodiments in which the magnet 3 is not free to revolve inside the rake body 1, a non-revolvable portion of the magnet may be attached, using a revolvable connector, to a threaded and revolvable portion of the magnet to which the pull ring 45 or other magnet handle may be attached. The non-revolvable portion of the magnet may be inserted into the rake body 1, and the threaded revolvable portion 46 may be screwed into a threaded portion inside the rake body 1.

In other embodiments, other methods of holding the magnet 3 firmly in place inside the rake body 1 during use may be used. For example, in one embodiment, suitable for use with a square magnet such as the magnet 3 shown in FIG. 3 or with a magnet 3 of another shape, a small piece of ferro-metallic material, such as a small disk of steel, approximately 1" in diameter and 1/16" in thickness, may be attached inside the hollow interior rake body 1 at an end of the rake body 1 that is opposite an end at which the pull ring 45 is located. When the magnet 3 is inserted into the rake body 1, a magnetic attraction exists between the small piece of ferro-metallic material and the magnet 3, which is sufficient to hold the magnet 3 in place inside the rake body 1. When a user exerts force on the pull ring 45 in order to withdraw the magnet 3, the magnetic attraction between the magnet 3 and the small piece of ferro-metallic material is sufficiently weak to allow the magnet 3 to be easily withdrawn from the rake body 1. In other embodiments, the magnet 3 is shaped to closely fit some or all of the interior cavity of the rake body 1, and the magnet may be held in place within the rake body 1 by friction. In still other embodiments, a rubber-like coating may be applied to at least a portion of a surface of the magnet 3, thereby providing a surface easily held in place inside the rake body 1 by friction. Other suitable methods of holding the magnet 3 in place during use may become apparent, in light of this disclosure, to a skilled practitioner of the art.

In other embodiments, the magnet 3 may be shaped into any of a wide variety of other shapes that may fit inside the rake body 1. Furthermore, in some embodiments of the magnetic rake 10, one magnet 3 is used; in other embodiments, a plurality of magnets 3 is used. The plurality of magnets may be combined into a single structure, such as by stringing the plurality of magnets 3 on a string or chain or other connector, or by enclosing the plurality of magnets into a resin-based, rubber, acrylic, or other compound that, when hardened, provides a plastic-like casing for the magnets 3 that may be shaped as a rod or other shape that fits inside the hollow rake body 1.

In various embodiments, the ring pull 45 may be attached to the magnets 3 using glue, may be formed to screw into an end of the magnet 3, and/or may be attached to the magnet 3 using another method. Furthermore, in some embodiments, instead of using a pull ring 45 to hold on to the magnet 3, a knob or other mechanism for holding on to the magnet 3 may be used.

In some embodiments, a mechanism for storing the magnet 3 when it is outside of the rake body 1 may be provided. For example, a hook, a pouch, or an elastic band, may be provided on the rake handle 8, on the rake body 1, or separately from the rake 10, in order to allow the magnet 3 to be stored while keeping the rake 10 in a non-magnetic state. In some embodiments, in order to avoid loss of the magnet 3 while it is withdrawn from the rake body 1, a connector, such as a cord, elastic, spring, or the like, attaches the magnet 3 to the rake body 1 while allowing the magnet 3 to be withdrawn from the rake body 1 a sufficient distance to eliminate magnetic attraction of the debris to the rake body 1.

Figure 5A:
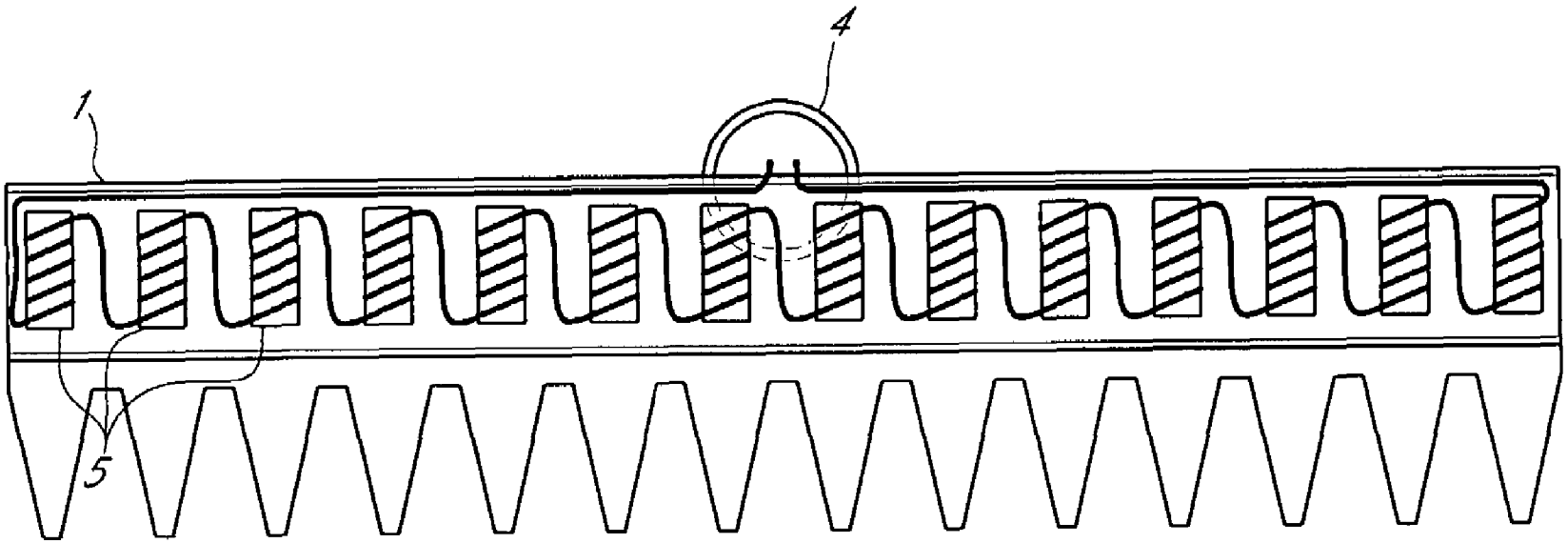
FIG. 5A depicts an embodiment of a rake body that includes electromagnets.
Figure 5B:
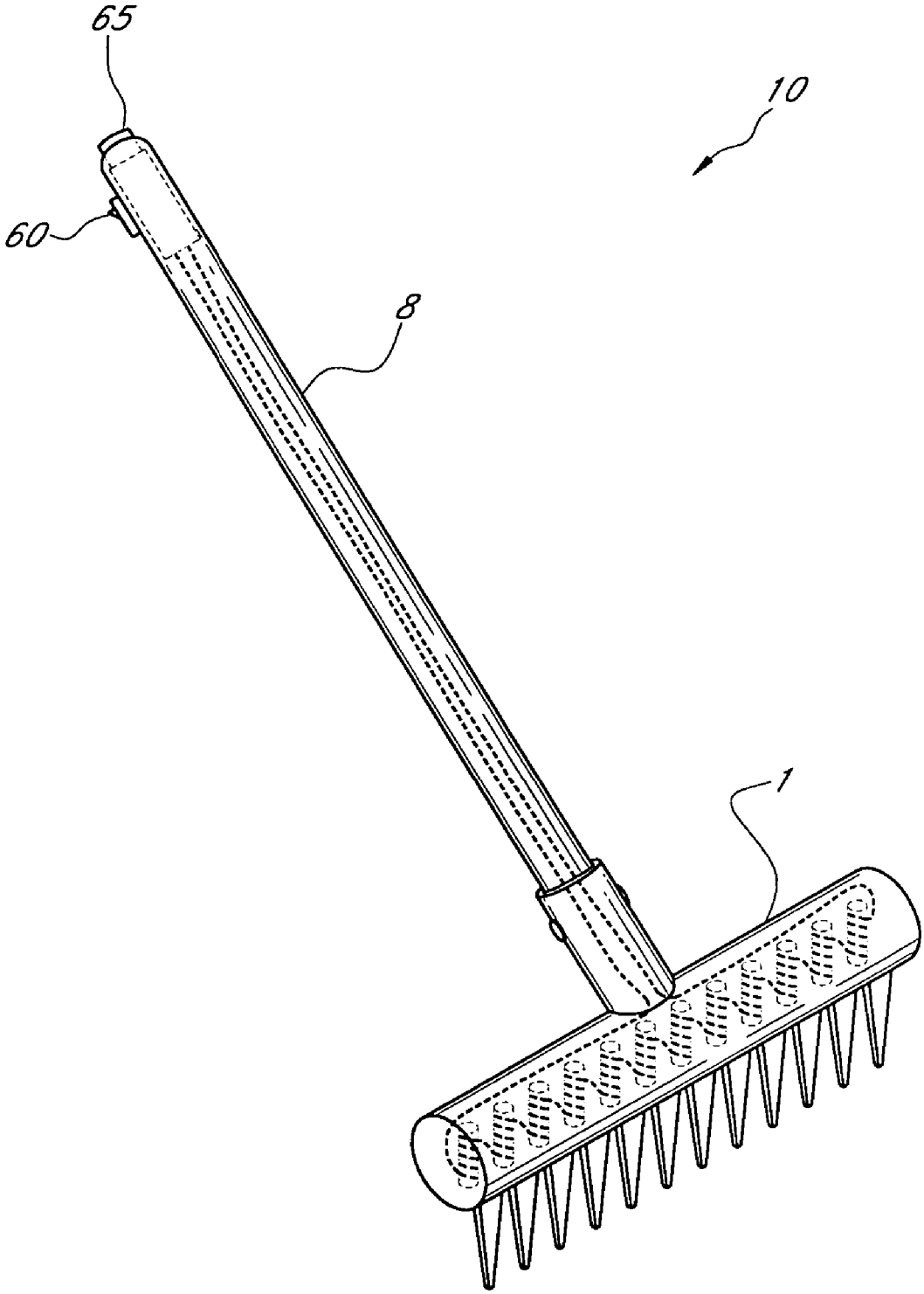
FIG. 5B depicts an embodiment of a magnetic rake that uses a rechargeable battery to power electromagnets in the rake body.

FIGS. 5A and 5B depict an embodiment of a magnetic rake 10 in which one or more electromagnets 5 provide magnetic attraction to the rake body 1. A plurality of electromagnets 5 inside the toothed rake body 1 are connected in series to a source of electricity, which in the embodiment depicted in FIG. 5B, is a removable, rechargeable battery 65 inserted into the rake handle 8 and activated by a switch 60, also on the handle 8. The use of electromagnets 5 allows for a release mechanism that can eliminate and restore magnetic attraction to the rake body 1, thereby allowing even small and/or lightweight particles of debris to be dropped from the rake body 1. When electricity is provided to the magnets 5, they exert a magnetic field, and ferro-metallic objects are electromagnetically attracted to the rake body 1. When the electrical current to the electromagnets is turned off, the attractive force ceases, and the attracted objects are free to fall away from the rake body 1.

A variety of other types of power sources may additionally or alternatively be used for different embodiments of the magnetic rake 10. For example, other embodiments of the magnetic rake 10 may use one or more replaceable, non-rechargeable batteries, or one or more permanently installed rechargeable batteries, or an electric cord that allows for connection to a source of alternating current to power the electromagnets 5 in the rake body 1. One or more solar batteries may be used to power the electromagnets 5, which may be recharged, in yet other embodiments, while installed in the magnetic rake 10, by using a small solar collector installed on the rake 10, or while detached from the magnetic rake 10.

As will be familiar to a skilled practitioner upon review of the current disclosure, other configurations of electromagnets 5 inside the rake body 1 may additionally or alternatively be provided to electromagnetically attract ferro-metallic debris to the rake body 1. Furthermore, other configurations for connection to a source of power and/or for providing a switching mechanism 60 may be used in other embodiments. For example, in some embodiments, the switch 60 may be provided on the rake body, so that a user may activate the switch 60 by stepping on it or pushing with the foot, rather than by pressing it by hand.

Although the foregoing systems and methods have been described in terms of certain preferred embodiments, other embodiments will be apparent to those of ordinary skill in the art from the disclosure herein. Additionally, other combinations, omissions, substitutions and modifications will be apparent to the skilled artisan in view of the disclosure herein.

For example, although the ferro-metallic material that may be collected by the magnetic rake has been characterized in various locations throughout the disclosure as "debris," in some embodiments, the ferro-metallic material may be of some value, and its collection may be more along the lines of a harvest than a trash removal. Release of the material, such as into a recycling or other collection container, may be effected using various embodiments of the release mechanism described herein.

As another example, other embodiments of the magnetic rake 10 may include one or more other types of release mechanisms that eliminate magnetic attraction to the rake body 1, for example by cancelling out a first magnetic field of one polarity with a second magnetic field of an opposite polarity. One contemplated embodiment uses at least one electromagnet in combination with at least one permanent magnet. In this embodiment, the at least one permanent magnet 3 may be used to provide the magnetic force for attracting and picking up items and debris. An electromagnet 5 situated appropriately with respect to the at least one permanent magnet 3 may then be used to overpower or cancel the effect of the permanent magnet 3, either momentarily or for a longer duration, thereby allowing the items and debris to fall from the rake 10. As with the embodiments described with reference to FIGS. 5A and 5B, the electromagnets 5 are controlled by a flow of electricity, which is preferably regulated by a switch 60 located on the rake 10. Preferably, the switch 60 is on the handle 10.

In various other embodiments, the release mechanism functions by mechanically moving appropriately positioned sets of permanent magnets 3 of opposite polarities past one another, causing their fields to cancel one another, thus reducing the net magnetic force of the magnets 3 to zero, and allowing the ferro-metallic material to fall from the rake body 1.

For example, one set of permanent magnets 3 used to attract metallic material may be positioned in a fixed position near the toothed portion 2 of the rake body 1, with space in between the magnets 3. Another set of permanent magnets 3, this set being movable, is interspaced between the magnets 3 of the fixed set. The poles of the movable set of magnets are aligned to oppose the orientation of the fixed set. A movement mechanism exists to move the movable set of magnets in the direction of the fixed magnets. In one embodiments the movement mechanism comprises a platform piece to which one end of each of the movable magnets is attached. Thus, when the platform piece is moved, the set of movable magnets is moved. In one embodiment, a release handle extends from the platform outside the rake body 1. The user may move this release handle to move the magnets 3 into a position in which the magnetic field at the toothed portion 2 of the rake body 1 is cancelled. In other embodiments, other methods of moving the platform may be used.

While certain embodiments of the invention have been described, these embodiments have been presented by way of example only, and are not intended to limit the scope of the inventions. Indeed, the novel methods and systems described herein may be embodied in a variety of other forms without departing from the spirit thereof. The accompanying claims and their equivalents are intended to cover such forms or modifications as would fall within the scope and spirit of the invention.

What is claimed is:

1. A magnetic rake, comprising:

a hollow, unitarily-formed, toothed rake body configured to enclose a first set of one or more magnets that attract ferro-metallic material to said rake body; and a release means that eliminates attraction of said ferro-metallic material to said hollow, unitarily-formed, toothed rake body without dismantling said hollow, unitarily-formed, toothed rake body.

2. The magnetic rake of claim 1, wherein said release means allows said ferro-metallic material to drop from said rake body.

3. The magnetic rake of claim 1, wherein said release means allows said one or more magnets to be withdrawn from said rake body without dismantling said hollow, unitarily-formed, toothed rake body.

4. The magnetic rake, comprising:

a hollow, unitarily-formed, toothed rake body configured to enclose a first set of one or more magnets that attract ferro-metallic material to said rake body; and a release that eliminates attraction of said ferro-metallic material to said rake body; wherein said release allows said one or more magnets to be withdrawn from said rake body, said release further comprising at least one handle on at least one of said magnets, said handle allowing a user to grasp said handle and to manually withdraw said magnet.

5. A magnetic rake comprising:

a hollow, unitarily-formed, toothed rake body configured to enclose a first set of one or more magnets that attract ferro-metallic material to said rake body;

a release that eliminates attraction of said ferro-metallic material to said rake body, wherein said release allows said one or more magnets to be withdrawn from said rake body; and at least one barrier for preventing said ferro-metallic material from attaching to said one or more magnets that are withdrawn from said rake body.

6. A magnetic rake comprising:

a hollow, unitarily-formed, toothed rake body configured to enclose a first set of one or more magnets that have a magnetic field of a first polarity and that attract ferro-metallic material to said rake body; and a release that eliminates attraction of said ferro-metallic material to said rake body;

wherein said hollow, unitarily-formed, toothed rake body is further configured to enclose a second set of one or more magnets, and wherein said release is configured to activate a magnetic field of a second polarity of said second set of one or more magnets that cancels the magnetic field of said first set of one or more magnets.

7. The magnetic rake of claim 1, wherein said hollow, unitarily-formed, toothed rake body is formed of a non-magnetic alloy.

8. The magnetic rake of claim 7, wherein said non-magnetic alloy is aluminum.

9. A method of removing ferro-metallic material from a surface area, comprising:

magnetically attracting ferro-metallic material from a surface area to a hollow, unitarily-formed, toothed rake body that contains at least one magnet and that comprises a release means that eliminates said magnetic attraction to said hollow, unitarily-formed, toothed rake body; and activating said release means to allow said ferro-metallic material to drop from said rake body.

10. The method of claim 9, wherein magnetically attracting ferro-metallic material from a surface area comprises raking said surface area with said rake body.

11. The method of claim 9, wherein activating said release means comprises removing said at least one magnet from inside said rake body without dismantling said hollow, unitarily-formed, toothed rake body.

12. A system for removing ferro-metallic debris from a surface area, comprising:

a hollow, unitarily-formed, toothed rake body that contains at least one magnet for magnetically attracting ferro-metallic material from said surface area to said hollow, unitarily-formed, toothed rake body; and means for eliminating said magnetic attraction to said hollow, unitarily-formed, toothed rake body.

13. The system of claim 12, wherein said means for eliminating said magnetic attraction to said hollow, unitarily-formed, toothed rake body comprise means for removing said magnets from said hollow, unitarily-formed, toothed rake body.

14. The magnetic rake of claim 6, wherein:

said first set of one or more magnets comprises at least one permanent magnet; and said second set of one or more magnets comprises at least one electromagnet.

* * * * *

UNITED STATES PATENT AND TRADEMARK OFFICE

CERTIFICATE OF CORRECTION

PATENT NO. : 7,331,470 B2
APPLICATION NO. : 11/338607
DATED : February 19, 2008
INVENTOR(S) : Bradley G. Vernon and Patrick D. Arnold It is certified that error appears in the above-identified patent and that said Letters Patent is hereby corrected as shown below:

Column 9, line 19, delete "embodiments" and insert -- embodiment, --, therefor.

Column 9, line 53, in Claim 4, delete "The" and insert -- A --, therefor.

Signed and Sealed this

Nineteenth Day of August, 2008

JON W. DUDAS
*Director of the United States Patent and Trademark Office*